US005987950A

United States Patent [19]

Horton

[11] Patent Number: 5,987,950

[45] Date of Patent: Nov. 23, 1999

[54] HYDROFORMING OF A TUBULAR BLANK HAVING AN OVAL CROSS SECTION

[75] Inventor: Frank A. Horton, Rochester Hills, Mich.

[73] Assignee: Cosma International Inc., Concord Ontario, Canada

[21] Appl. No.: 09/115,588

[22] Filed: Jul. 15, 1998

Related U.S. Application Data

[60] Provisional application No. 60/053,060, Jul. 18, 1997.

[51] Int. Cl.[6] ..... B21D 26/02

[52] U.S. Cl. ..... 72/58; 72/58; 72/61

[58] Field of Search ..... 72/57, 58, 61, 72/62

[56] References Cited

U.S. PATENT DOCUMENTS

| | | | |
|---|---|---|---|
| 5,070,717 | 12/1991 | Boyd et al. | 72/57 |
| 5,170,557 | 12/1992 | Rigsby | 29/890.08 |
| 5,214,948 | 6/1993 | Sanders . | |
| 5,259,268 | 11/1993 | Ebbinghaus . | |
| 5,339,667 | 8/1994 | Shah et al. | 72/58 |
| 5,353,618 | 10/1994 | Roper et al. | 72/58 |
| 5,479,699 | 1/1996 | Snyder . | |
| 5,491,883 | 2/1996 | Marlinga . | |
| 5,557,961 | 9/1996 | Ni et al. | 72/61 |
| 5,561,902 | 10/1996 | Jacobs et al. | 29/897.2 |
| 5,815,901 | 10/1998 | Mason et al. | 72/58 |
| 5,845,382 | 12/1998 | Schultz et al. | 72/61 |
| 5,862,877 | 1/1999 | Horton et al. | 72/61 |

FOREIGN PATENT DOCUMENTS

| | | | |
|---|---|---|---|
| 588528 | 3/1994 | European Pat. Off. | 72/58 |

*Primary Examiner*—David Jones
*Attorney, Agent, or Firm*—Pillsbury Madison & Sutro LLP

[57] ABSTRACT

The present invention relates to a method and apparatus for forming an elongated tubular metal member from a tubular metal blank. The method comprises: i) placing a tubular metal blank having a generally oval cross-section into a die cavity and orienting the tubular metal blank such that a relatively larger cross-sectional dimension of the generally oval cross-section extends generally in a direction of the relatively larger cross-sectional dimension of the die cavity and such that a relatively smaller cross-sectional dimension of the generally oval cross-section extends generally in a direction of the relatively smaller cross-sectional dimension of the die cavity; ii) engaging and sealing opposite ends of the tubular metal blank; and iii) injecting fluid under pressure into the tubular metal blank so as to expand the tubular metal blank into conformity with the surfaces defining the die cavity and thereby transform the tubular metal blank into the elongated tubular metal member.

29 Claims, 7 Drawing Sheets

HYDROFORMING OF A TUBULAR BLANK HAVING AN OVAL CROSS SECTION

This application claims the benefit of provisional application No. 60/053,060, filed Jul. 18, 1997.

BACKGROUND OF THE INVENTION

The present invention relates generally to hydroforming methods and die assemblies, and more particularly to a hydroforming method and die assembly for hydroforming a tubular metal blank in a manner which avoids the need for a pre-crush operation for inserting the blank into the die cavity.

Hydroforming methods are commonly known as a means for shaping a tubular metal blank having a circular cross section into a tubular component having a predetermined desired configuration. In particular, a typical hydroforming operation involves the placement of a tubular metal blank having a circular cross section into a die cavity of a hydroforming assembly and providing high pressure fluid to the interior of the blank to cause the blank to expand outwardly into conformity with the surfaces defining the die cavity. More particularly, the opposite longitudinal ends of the tubular metal blank are sealed by hydraulic rams, and high pressure hydroforming fluid is provided through a port formed in one of the rains to expand the tubular blank.

Typically, the tubular blank having the circular cross-section is roll formed from sheet metal into its initial configuration. The roll formed tubular blank must then he placed into the hydroforming die cavity, typically having a boxed, rectangular, or irregular cross-section. Because the circumference of a circular tubular blank that would fit easily into the die cavity is significantly less than the circumference or cross-sectional perimeter of the surfaces defining the die cavity, significant expansion of the blank would be necessary to conform the blank to the die cavity. Such significant expansion may cause significant wall thinning of the tubular blank, so that a blank of substantial initial wall thickness would be required. Moreover, if such significant expansion is required, it becomes more difficult for the blank to conform into the corners within the die cavity. To minimize the amount of expansion necessary and to provide a tubular blank that has a circumference that initially conforms more closely to the cross sectional perimeter of the die cavity, it has been a conventional practice to provide a tubular blank having circular cross-sectional diameter that is greater than the width of the die cavity and to crush the tube diametrically in a pre-crush station to enable the tube to be initially placed into the relatively narrow die cavity. The pre-crush operation, however, is costly in that it requires dedicated machinery and is time consuming.

It is object of the present invention, therefore, to eliminate the need for the costly pre-crush operation while using a tubular blank that conforms better to the contours of the die cavity. This object is achieved in accordance with the principles of the present invention by a method of forming an elongated tubular metal member having a cross-sectional configuration such that it includes a first cross-sectional dimension which is greater than a second cross-sectional dimension orthagonal to the first cross-sectional dimension along an extent thereof. The method utilizes a die assembly having first and second die structures having surfaces cooperable to define a die cavity having a first cross-sectional dimension which is greater than a second cross-sectional dimension generally orthagonal to the first cross-sectional dimension. The method comprises i) roll-forming sheet metal to form a tubular metal blank having an oval cross-section, the oval cross-section including a major axis along a greater diameter thereof and a minor axis along a smaller diameter thereof, the major and minor axes being generally orthagonal to one another; ii) placing the tubular metal blank into the second die structure, the second die structure being constructed and arranged to receive the tubular metal blank having the oval cross-section without distorting the tubular metal blank from its oval cross-section, the tubular metal blank being placed into the second die structure such that the major axis of the oval cross-section thereof extends in generally the same direction as the first cross-sectional dimension when the first and second die structures cooperate to form the die cavity and such that the minor axis of the oval cross-section thereof extends in generally the same direction as the second cross-sectional dimension of the die cavity when the first and second die structures cooperate to form the die cavity; iii) engaging opposite ends of the tubular metal blank with tube-end engaging structures so as to substantially seal opposite ends of the tubular metal blank; and iv) injecting fluid under pressure into the tubular metal blank placed in the die cavity to expand the tubular metal blank into conformity with the surfaces defining the (die cavity.

The object is also achieved in accordance with the principle of the present invention by an apparatus for forming a tubular metal blank into an elongated tubular metal member having a substantially box-shaped transverse cross-section along an extent thereof. The apparatus comprises a die assembly having an internal die surface defining a die cavity, the die cavity having a substantially box-shaped surface configuration and being constructed and arranged to receive the tubular metal blank having a generally oval cross-section. Clamping structures are positioned on opposite ends of the die cavity and constructed and arranged to securely clamp spaced-apart portions of the tubular metal blank. The clamping structures present clamping surfaces defining a generally oval surface configuration generally conforming to a generally oval outer peripheral surface of the tubular metal blank. The apparatus further comprises tube-end engaging structure constructed and arranged to engage and substantially seal opposite ends of the tubular metal blank, the tube-end engaging structure presenting a generally oval outer surface configuration conforming to a generally oval inner peripheral surface of the tubular metal blank.

The object is also achieved in accordance with the principles of the present invention by providing a method of forming an elongated tubular metal member, the elongated tubular metal member being formed in a die cavity having surfaces constructed and arranged to provide the die cavity with a shape generally corresponding to a shape of the of the elongated tubular member. The cross-section of the elongated tubular member and hence of the die cavity has a relatively larger dimension thereof transverse to a relatively smaller dimension thereof. The method comprises: i) placing a tubular metal blank having a generally oval cross-section into the die cavity and orienting the tubular metal blank such that a relatively larger cross-sectional dimension of the generally oval cross-section extends generally in a direction of the relatively larger cross-sectional dimension of the die cavity and such that a relatively smaller cross-sectional dimension of the generally oval cross-section extends generally in a direction of the relatively smaller cross-sectional dimension of the die cavity; ii) engaging and sealing opposite ends of the tubular metal blank; and iii) injecting fluid under pressure into the tubular metal blank so as to expand the tubular metal blank into conformity with the surfaces defining the die cavity and thereby transform the tubular metal blank into the elongated tubular metal member.

Other objects and advantages of the present invention will be realized in accordance with the following detailed description, appended drawings and claims.

DETAILED DESCRIPTION OF THE DRAWINGS

Figure 1:
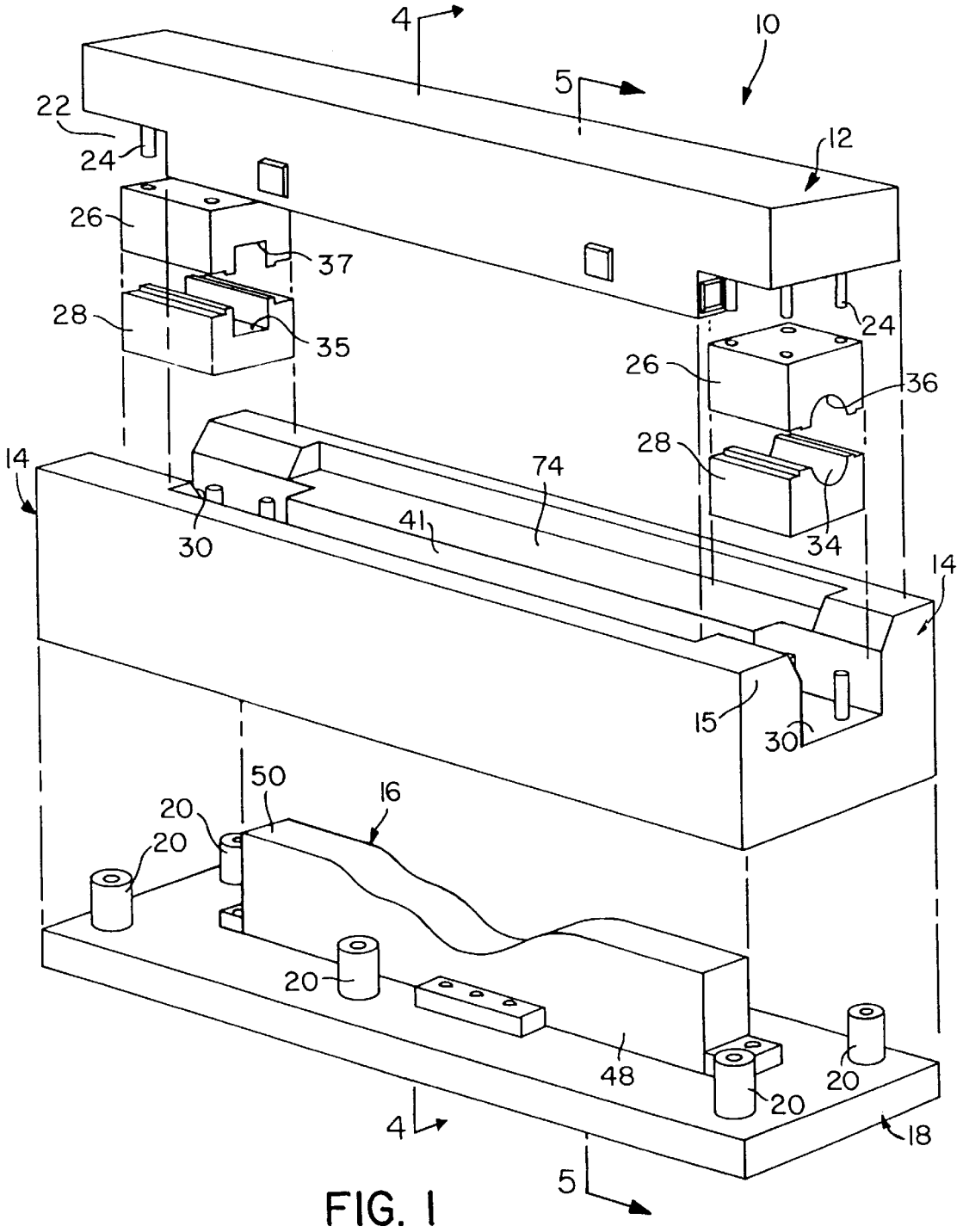
FIG. 1 is an exploded perspective view showing upper and lower die structures of a hydroforming die assembly in accordance with the principles of the present invention.

Shown generally in FIG. 1 is a perspective view of a hydroforming die assembly generally indicated at 10 in accordance with the present invention. The hydroforming die assembly 10 includes first and second die structures. More particularly, the first die structure comprises a movable upper die structure 12, while the second die structure comprises a movable lower die structure 14 and a fixed die structure 16. The die assembly further comprises a fixed base 18 on which the fixed die structure 16 is mounted. A plurality of pneumatic or nitrogen spring cylinders 20 mount the lower die structure 14 for movement on the fixed base 18. The upper die structure 12, lower die structure 14, and fixed die structure 16 cooperate to define a longitudinal die cavity therebetween, having a substantially box-shaped cross section as will be described herein. Preferably, the upper die structure 12, lower die structure 14, fixed die structure 16, and fixed base 18 are each made of an appropriate steel material such as P-20 steel.

As shown in FIG. 1, the upper die structure 12 defines a pair of cradle areas 22 at opposite longitudinal ends thereof. The cradle areas 22 are shaped and arranged to receive and accommodate upper clamping structures 26, at opposite longitudinal ends of the upper die structure 12. Particularly, the clamping structures 26 are each connected to the upper die structure 12 at the respective cradle areas 22, by a plurality of pneumatic spring cylinders 24 which permit relative vertical movement between the clamping structures 26 and the upper die structure 12.

The lower die structure 14 has similar cradle areas 30 at opposite longitudinal ends thereof which are constructed and arranged to accommodate lower clamping structures 28 in a similar fashion. As shown, the longitudinal ends, indicated at 15, forming cradle area 30 of the lower die structure 14 have a generally U-shaped configuration.

The lower clamping structures 28 each have an arcuate, generally parabolic upwardly facing surface 34. More particularly, each surface 34 has a cross-sectional configuration that defines one-half of an oval. The surfaces 34 are constructed and arranged to engage and cradle the underside of a tubular blank 40 (see FIG. 2) having an oval cross-section and placed in the lower die structure. Each of the arcuate surfaces 34 of the lower clamping structures 28 extend longitudinally inwardly toward the central portions of the hydroforming die assembly 10 when they gradually transition into a substantially rectangular or box U-shaped surface configuration 35.

Figure 2:
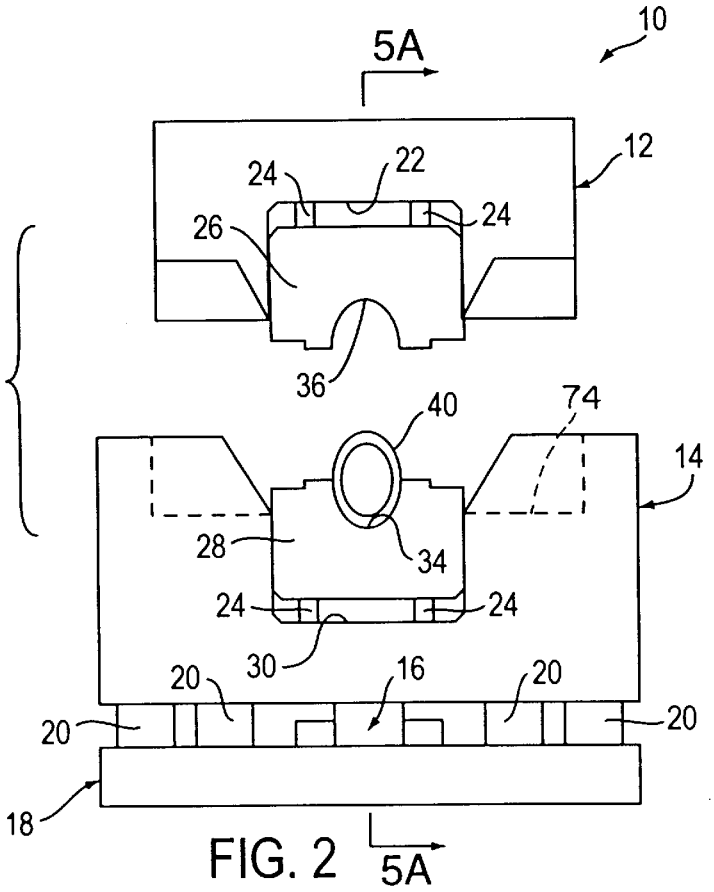
FIG. 2 is a side plan view showing the longitudinal end of a hydroforming die assembly in accordance with the present invention with an oval tubular blank positioned into the lower die structure and the upper die structure in the raised or opened position.

The upper two clamping structures 26 are substantially identical to the lower clamping structures 28 but are inverted with respect thereto. More particularly, each upper clamping structure 26, has an arcuate, generally parabolic, downwardly facing surface 36 which transitions into an inverted box U-shaped surface configuration 37. The arcuate surfaces 36 each have a cross-sectional configuration that defines the other half of an oval. As shown in FIG. 2, the arcuate surface 36, of each clamping structure 26, cooperates with arcuate surface 34, of the respective lower clamping structures 28, to form an oval clamping surfaces that capture and sealingly engage the opposite ends of the oval tubular blank 40 when the upper die structure 12 is initially lowered.

Figure 4:
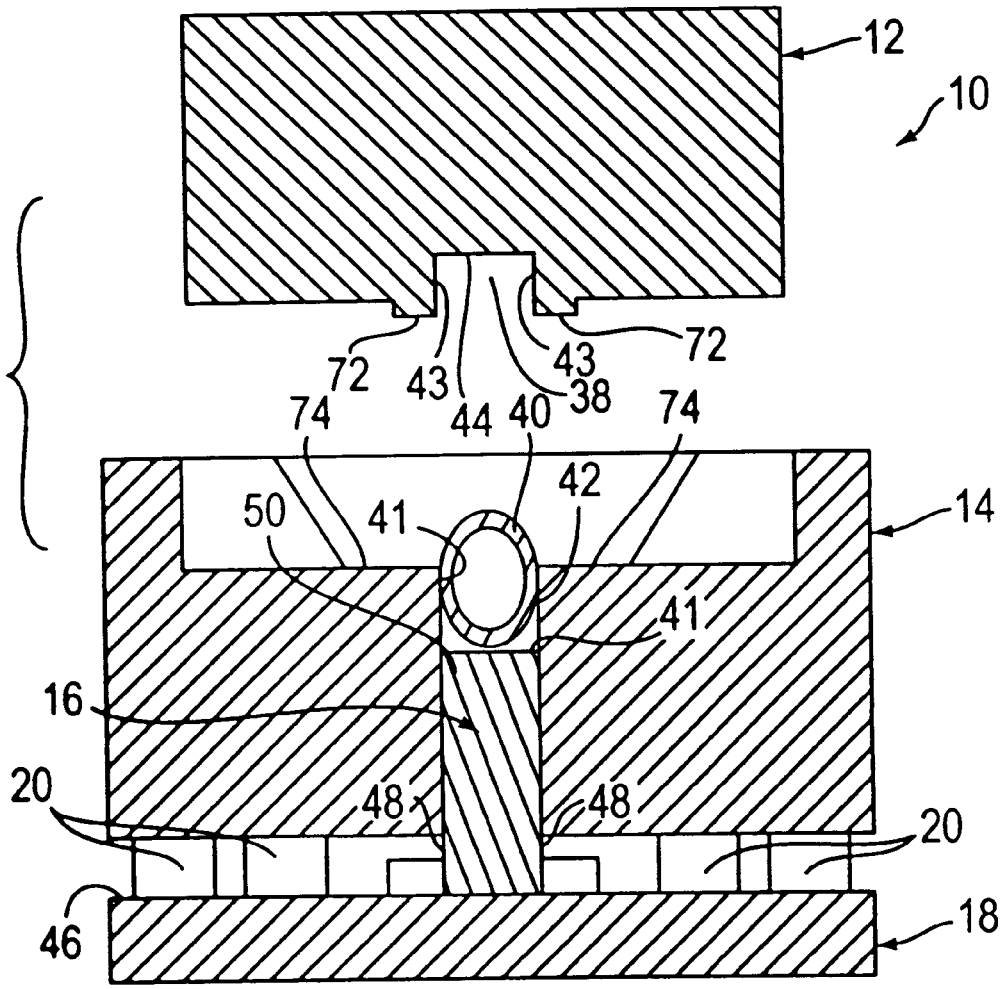
FIG. 4 is a cross-sectional view through the middle of the die assembly, and an oval shaped tubular blank positioned within the lower die structure and the upper die structure in the raised or fully open position.
Figure 5A:
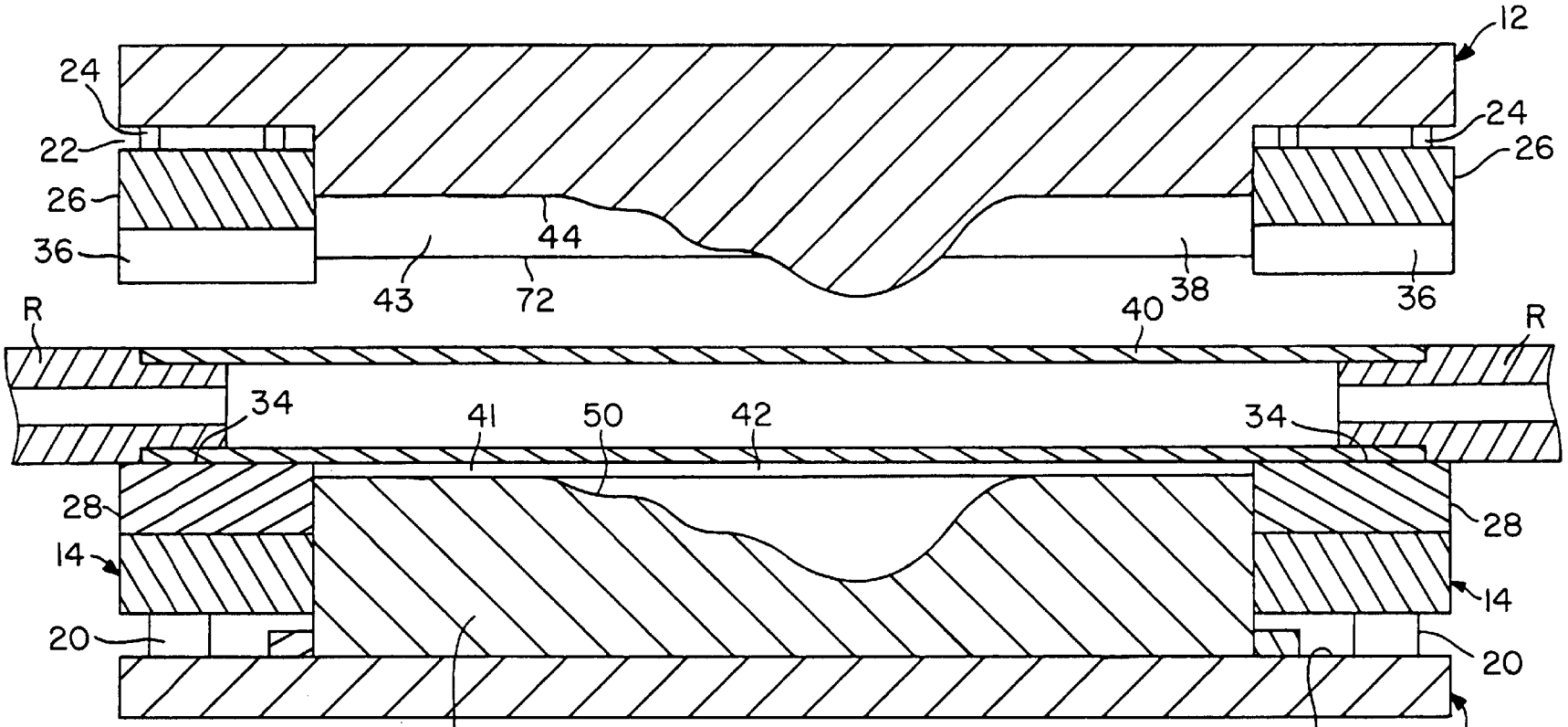
FIG. 5A is a longitudinal sectional view, of the hydroforming die assembly, in accordance with the present invention, showing the upper die structure in a fully raised position, an oval tubular blank positioned within the lower die structure, and hydroforming cylinders sealingly inserted into opposite ends of the oval tubular blank.

As can be appreciated from FIGS. 4 and 5A, the upper die structure 12 defines a longitudinal channel 38 having a substantially inverted U-shaped cross section. The channel 38 is defined by a downwardly facing, generally horizontal longitudinally extending surface 44, and a pair of spaced, longitudinally extending vertical side surfaces 43, which extend parallel to one another from opposite sides of surface 44.

The lower die structure 14 has a central opening 42 extending vertically therethrough, between the U-shaped longitudinal ends 15. Interior vertical surfaces 41 in the lower die structure 14 define the aforementioned central opening 42. More particularly, a pair of longitudinally extending side surfaces 41, define the lateral extremities of the opening 42. The surfaces are vertically disposed in parallel facing relationship with one another. The U-shaped end portions 15 of the lower die structure 14, define the longitudinal extremities of the opening 42, and have interior surfaces (not shown) vertically disposed in parallel facing relation to one another.

The fixed base 18 is in the form of a substantially rectangular metal slab. The fixed die structure 16 is affixed to an upper surface 46 of the fixed base 18. The fixed die structure 16 is an elongate structure which extends along a major portion of the length of the upper surface 46 of the fixed base 18, generally along the transverse center of the fixed base 18. The fixed die structure 16 projects upwardly from the fixed base 18 and has substantially vertical side surfaces 48 on opposite longitudinal sides thereof. The fixed die structure 16 is constructed and arranged to extend within the opening 42 in the lower die structure 14, with minimal clearance between the generally vertical surfaces 48 of the fixed die structure and vertical surfaces 41 of the lower die structure 16. Similarly, there is minimal clearance between the interior transverse side surface of end portions 15 of the lower die structure 14 and the vertical end surfaces 49 of the fixed die structure 16. The fixed die structure 16, further includes an upwardly facing generally arcuate, horizontal, and longitudinally extending die surface 50, which is constructed and arranged to extend in spaced facing relation to the longitudinally extending die surface 44 of the upper die structure 12.

Figure 6:
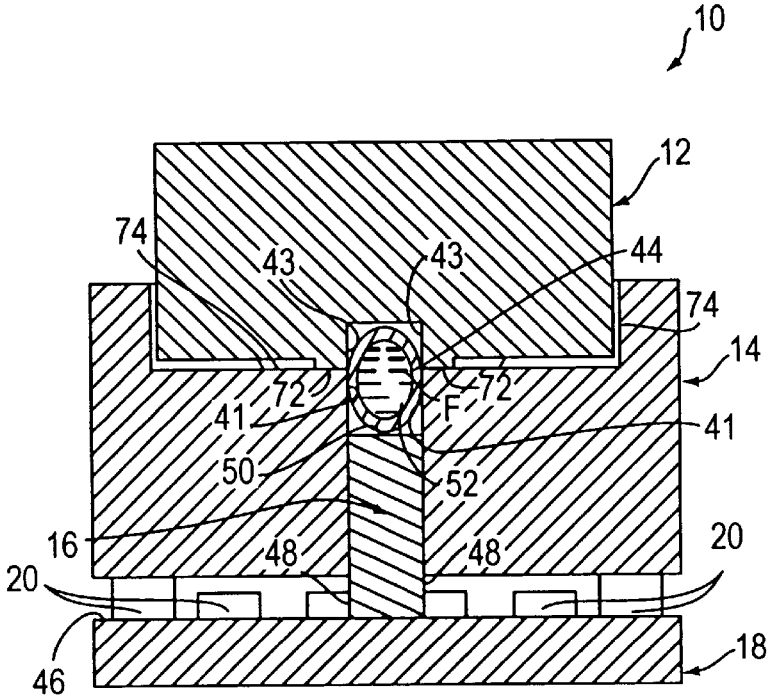
FIG. 6 is a sectional view showing the next step in the hydroforming process in accordance with the present invention wherein the upper die structure is in the fully lowered position and an oval shaped tubular blank positioned within the lower die structure.

As can best be seen in FIG. 6, the aforementioned side surfaces 41, the upwardly facing surface 50, the side surfaces 43 and downwardly facing surface 44 cooperate to provide a die cavity 52, having a generally rectangular shaped cross sectional configuration substantially throughout its longitudinal extent. This die cavity will form a hydroformed part having a substantially closed box cross-sectional configuration. The closed box cross-sectional configuration is preferably a quadrilateral, such as a generally rectangular configuration, but may be some other closed, continuous combination of planar and/or curved surface facets.

FIG. 4 shows the upper die structure 12 in an opened or raised position with respect to the lower die structure 14 and fixed base 18. In this position the hydroforming die assembly 10 enables the oval tubular blank 40 to be placed within the lower die structure 14. It can be appreciated from FIG. 5A that the oval tubular blank 40 to be hydroformed is suspended at opposite ends thereof by the lower clamping structures 28 to extend slightly above the upper surface 50 of the fixed die structure 16 when the tubular blank 40 is first placed in the hydroforming die assembly 10.

When the blank is placed in the lower die structure 14, opposite ends of the blank 40 rest upon the respective surfaces 34 of the lower clamping structures 28 at opposite ends of the lower die structure 14. Preferably, the surfaces 34 are constructed and arranged to form an interference fit with the lower portion of the respective opposite ends of the tubular blank 4.

Figure 3:
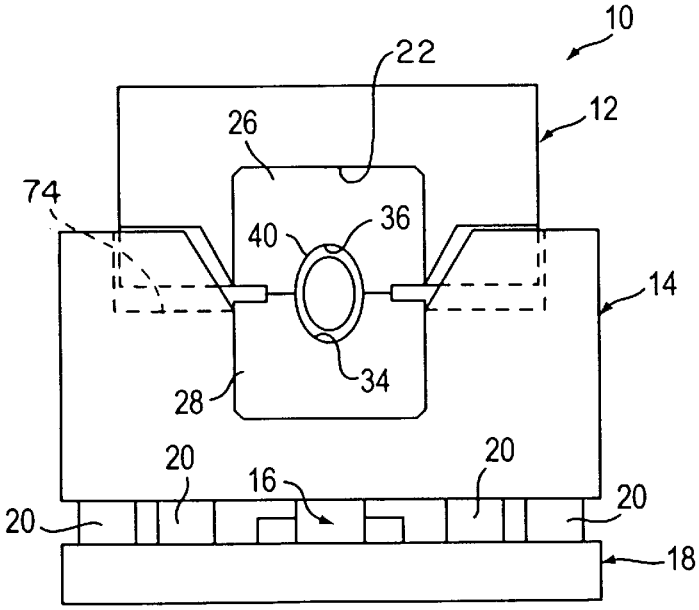
FIG. 3 is a plan view similar to that of FIG. 2 showing the hydroforming die assembly of the present invention with a tubular blank positioned in the lower die structure and the upper die structure in a lowered or closed position.

Subsequently, the upper die structure 12 is lowered so that the upper clamping structures 26 which are initially held in the extended position by pneumatic cylinders as shown in FIG. 2, is lowered as shown in FIG. 3 so that surface 36 forms in interference fit with the upper portion of the respective opposite ends of the tubular blank 40. At this point, both opposite ends of the tubular blank are captured between clamps 26 and 28 before the upper die structure 12 is lowered to its closed position.

In accordance with the method and apparatus of the present invention, the tubular blank 40 is provided with an oval cross-sectional configuration by a conventional roll-forming operation. More particularly, sheet metal is rolled until the longitudinal edges of the sheet metal meet to provide an oval configuration. The meeting edges are then seam welded to complete the tubular blank. Providing a tubular blank having an oval cross-section is advantageous in comparison with the conventional circular cross-section because it provides a circumference that conforms more closely to the final cross sectional perimeter of the generally rectangular (not square) cross-sectional shaped die cavity 52. As shown in the cross-section of FIG. 4, the diameter of the oval tube 40 along its minor axis closely approximates the distance between side surfaces 41 of the die cavity. As also shown, the cross-sectional configuration of the die cavity includes four corners. Thus, less expansion of the blank 40 is required when expanding the blank into conformity with the surfaces forming cavity 52.

It will be appreciated by those skilled in the art that the closer conformity of tube 40 and cavity surfaces allows the tube to be more easily expanded into the corners of the cavity 52, where expansion becomes most difficult due to the increasingly frictional surface contact between the exterior surface of the tube and cavity surfaces during expansion of the tube 40. In conventional practice it has been possible to provide a circular cross-sectional tubular blank with a cross-sectional perimeter that conforms closer to the die cavity cross-sectional perimeter by providing a circular cross-sectional diameter that is greater than the width of the die cavity 52 and crushing the tube laterally in a pre-crush station to enable the tube to fit in the lower die structure. However, the pre-crush operation is costly in that it requires dedicated machinery and is time consuming. Use of an oval tubular blank enables the blank to fit in the lower die assembly, while providing a sufficient amount of metal in the die cavity without the necessity of a pre-crushing operation.

Figure 8:
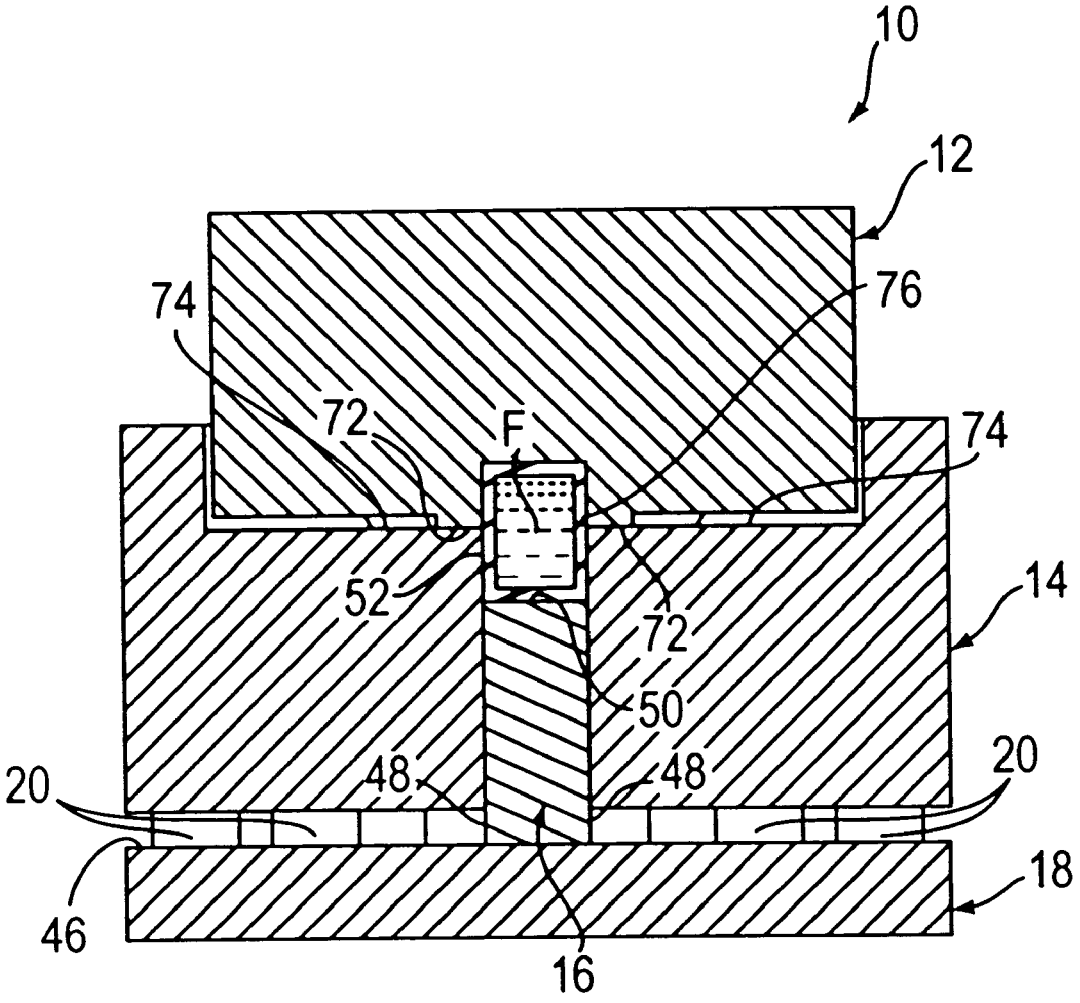
FIG. 8 is a sectional view showing a subsequent hydroforming step in which fluid under pressure expands the tubular blank into conformity with the die cavity.

The roll formed tubular metal blank 40 is to be hydroformed into an elongated tubular metal member (see reference numeral 76 in FIG. 8) that has a cross-sectional configuration such that it includes a first cross-sectional dimension (e.g., the distance between the horizontal walls of member 76 in FIG. 8) which is greater than a second cross-sectional dimension (e.g., the distance between the vertical walls of member 76 in FIG. 8) orthagonal to the first cross-sectional dimension along a predetermined longitudinal extent thereof. This results from the fact that the first die structure 12 and the second die structure 14, 16 have surfaces cooperable to define a die cavity 52 having a first cross-sectional dimension (e.g., a vertical dimension of a length between surfaces 44 and 50) which is greater than a second cross-sectional dimension (e.g., a horizontal dimension of a relatively shorter length between surfaces 41, or between surfaces 43) generally orthagonal to the first cross-sectional dimension.

As inherent with any oval, the oval cross-section of the tubular blank includes a major axis along a greater diameter thereof and a minor axis along a smaller diameter thereof, the major and minor axes being generally orthogonal to one another. As shown in FIG. 4, the tubular metal blank 40 is placed into the second die structure 14, 16. As also shown, the second die structure 14, 16 is constructed and arranged to receive the tubular metal blank 40 without distorting the tubular metal blank from its oval cross-section. As shown in FIG. 6, the tubular metal blank 40 is placed into the second die structure 14, 16 such that the major axis of the oval cross-section thereof extends in generally the same direction as the first, longer cross-sectional dimension (e.g., extending between surfaces 44 and 50) when the first die structure 12 and second die structure 14, 16 cooperate to form the die cavity 52, and such that the minor axis of the oval cross-section thereof extends in generally the same direction as the second, shorter cross-sectional dimension (e.g., extending between opposing surfaces 41) of the die cavity 52 when the first and second die structures cooperate to form the die cavity.

Now as can be seen in FIG. 5A, the oval blank 40 is substantially rigidly held in place to permit tube-end engaging structures, such as hydroforming cylinders or rams R, to be telescopically and sealingly inserted into both opposite ends of the tube 40. The rams R preferably have an oval outer surface configuration that conforms to the inner peripheral surface of the blank 40. The hydroforming cylinders preferably pre-fill, but do not pressurize to any large extent the oval blank 40, with hydraulic fluid (preferably water) as indicated by reference character F, before or simultaneously with the continued lowering of the upper die structure 12. Although the pre-filling operation is preferred to reduce cycle times, and to achieve a more smoothly contoured part, for some applications the upper die structure 12, may be fully lowered before any fluid is provided internally to oval blank 40.

As shown in FIG. 4, the upper die structure 12 preferably includes a pair of laterally spaced parallel ridges 72 projecting downwardly from opposite sides of the upper die cavity 38 and extend along the length of the upper die structure 12. When the upper die structure 12 is lowered, the ridges 72 are brought into engagement with an upper die surface 74, of the lower die structure 14 on opposite sides of the opening 42 so as to close and seal the die cavity 52 as shown in FIG. 6. The ridges 72 form a robust seal that can withstand extremely high cavity pressures of over 10,000 atmospheres.

Figure 7:
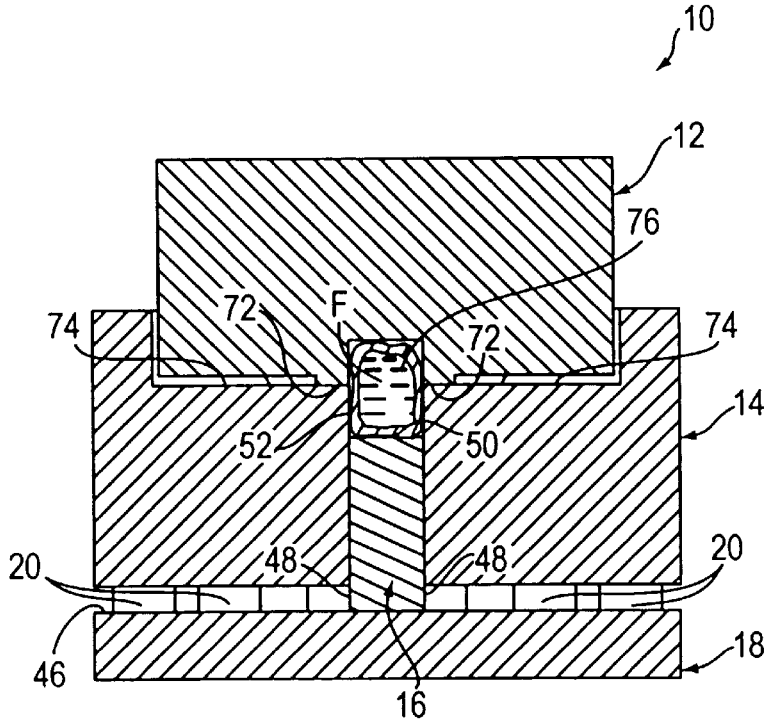
FIG. 7 is a sectional view showing the next hydroforming step wherein the upper die structure is in the fully lowered position and an oval shaped tubular blank to be hydroformed is slightly deformed or crushed by relative movement of the die structures.

As can be appreciated from FIGS. 6 and 7, after the initial engagement of the ridges 72 with the die surface 74, continued movement of the upper die structure 12 downwardly causes the lower die structure 14 to be forced downwardly therewith against the force of pneumatic spring cylinders 20. The oval blank 40 is likewise moved downwardly with the die cavity 52. During this continued downward movement of the upper die structure 12 and lower die structure 14, the die surface 44 of the upper die structure 12 is moved toward the die surface 50 of the fixed die structure 16 so as to reduce the size of the die cavity 52 while maintaining a substantial peripheral seal in the cavity. This arrangement, wherein the die cavity is closed and sealed before the size of die cavity 52 is reduced to crush the tube in the die prevents pinching of the tube, as can be appreciated from patent application Ser. No. 08/915,910, hereby incorporated by reference. The present invention does contemplate, however, that some crushing of the tube may occur prior to the upper die structure 12 engaging the lower die structure 14.

Figure 5B:
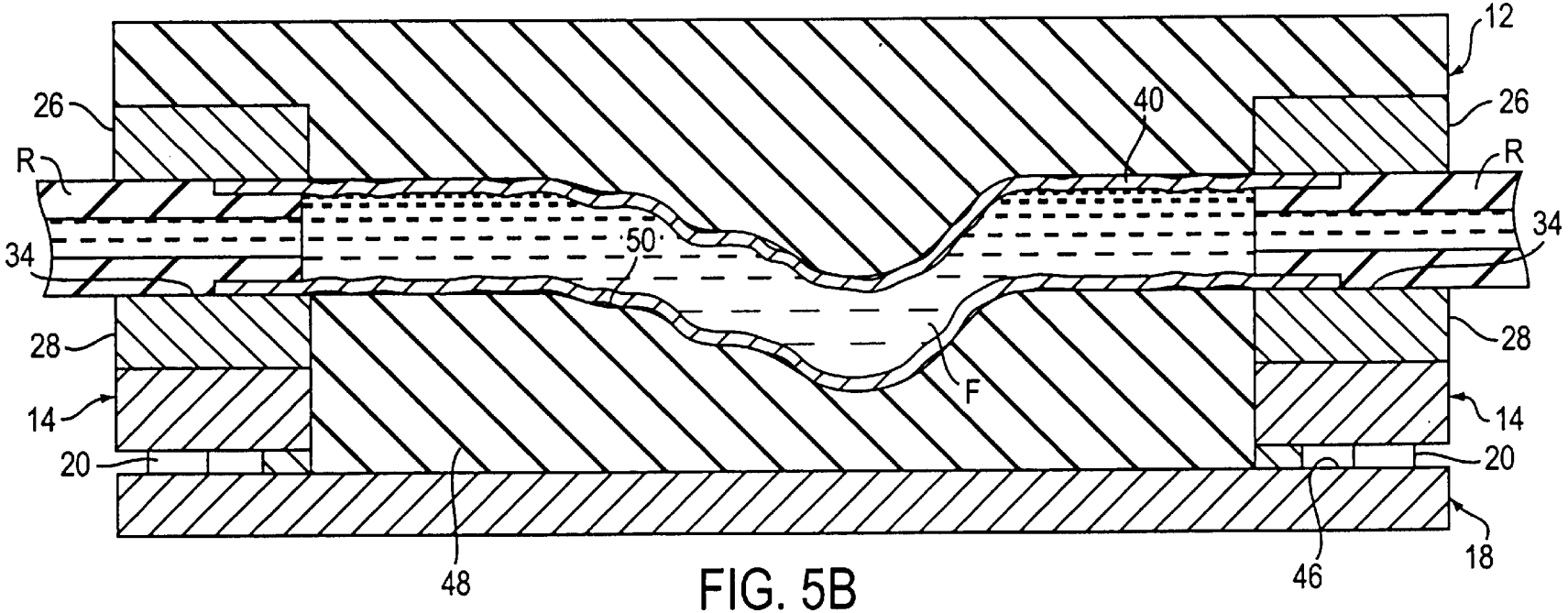
FIG. 5B is a longitudinal sectional view, of the hydroforming die assembly, in accordance with the present invention, showing the upper die structure in a fully lowered position, an oval tubular blank positioned within the die cavity defined by the upper and lower die structures and the fixed die structure, and fluid injected into the interior space of the oval tubular blank.

When the lower portion of oval blank 40 engages die surface 50, continued downward movement of the die structures 12 and 14 causes the oval blank 40 to deform. More specifically, when lower die surface 50 and upper die surface 44 communicate with upper and lower arcuate surface portions of oval blank 40, continued downward movement of die structures 12 and 14 cause die surfaces 50 and 44 to move inwardly toward each other. This forces the arcuate ends of the oval blank 40 to flatten and bend inwardly causing the oval blank 40 to be slightly crushed. This slight crushing of the oval blank 40 is performed so as to provide a circumference that conforms more closely to the final cross sectional perimeter of the boxed shaped die cavity 52. The blank is preformed along its longitudinal extent as shown in FIG. 5B. Because the oval blank 40 is preferably pre-filled with hydraulic fluid before this crushing, wrinkles in the tube resulting from crushing are generally avoided and a generally smoothly contoured hydroformed part can be formed.

As shown in FIG. 8, with the upper and lower die structures 12 and 14 in a fully lowered position, the hydraulic fluid inside the slightly crushed oval blank 40 is pressurized by the hydraulic system through one of the ends of the oval blank 40. During the hydroforming expansion of the oval blank 40, the fluid F is pressurized to an extent sufficient to expand the oval blank 40 radially outwardly into conformity with the die surfaces defining the generally boxed cross-section of die cavity 52. Preferably, fluid pressure between approximately 2000 to 3500 atmospheres is used, and the blank is expanded so as to provide a hydroformed part having a cross sectional area which is approximately 10% or more greater than that of the original oval blank 40. In addition, it is preferred that the longitudinal ends of the tube be pushed inwardly toward one another to replenish the wall thickness of the tube as it is expanded. More particulars on the preferred hydroforming operation are disclosed in U.S. Ser. No. 09/061,094, hereby incorporated by reference.

It can be appreciated that by utilizing a roll-formed, oval tubular blank for the hydroforming process, rather than a roll-formed cylindrical tubular blank, considerable savings is achieved due to the elimination of the pre-crush step and the oval tube can be utilized through the hydroforming steps without any interruption in the process. This reduces the required cycle time in that it eliminates the necessity of a pre-crush step while providing a sufficient amount of metal in the die cavity to form the blank into a desired final configuration.

It should be appreciated that the present invention contemplates alternate embodiments wherein the die cavity may be closed before it is sealed. Otherwise stated, the die cavity within the die assembly may be completed by having a cross-section bounded by adjoining surfaces, before the upper die structure contacts the lower die structure. In such an embodiment, for example, the upper die structure would be provided with a longitudinal projection rather than the channel 38. In addition, the longitudinal channel formed in the lower die structure 14 into which the tubular metal blank would be deeper to enable the longitudinal projection to enter the channel and thereby close the die cavity without the longitudinal projection contacting the tubular metal blank. The longitudinal projection may optionally thereafter contact the blank, either before or after the upper die structure contacts the lower die structure. It is also contemplated that the lower die structure may comprises a unitary fixed structure, rather than a combination of a movable and fixed structure as shown.

It should be appreciated that the foregoing detailed description and accompanying drawings of the preferred embodiment are merely illustrative in nature, and that the present invention includes all other embodiments that are within the spirit and scope of the described embodiment and appended claims.

What is claimed is:

1. A method of forming an elongated tubular metal member having a cross-sectional configuration such that it includes a first cross-sectional dimension which is greater than a second cross-sectional dimension orthagonal to said first cross-sectional dimension, said method utilizing a die assembly having first and second die structures having surfaces cooperable to define a die cavity having a first cross-sectional dimension which is greater than a second cross-sectional dimension generally orthagonal to said first cross-sectional dimension, said die cavity having a closed box cross-sectional configuration, said method comprising:

roll-forming sheet metal to form a tubular metal blank having an oval cross-section, said oval cross-section including a major axis along a greater diameter thereof and a minor axis along a smaller diameter thereof, said major and minor axes being generally orthagonal to one another;

placing the tubular metal blank into said second die structure, said second die structure being constructed and arranged to receive the tubular metal blank having said oval cross-section without distorting said tubular metal blank from its oval cross-section, said tubular metal blank being placed into said second die structure such that said major axis of said oval cross-section thereof extends in generally the same direction as said first cross-sectional dimension when said first and second die structures cooperate to form said die cavity and such that said minor axis of said oval cross-section thereof extends in generally the same direction as said second cross-sectional dimension of said die cavity when said first and second die structures cooperate to form said die cavity, said tubular metal blank having a diameter along said minor axis thereof which approximates said second cross-sectional dimension of said die cavity;

engaging opposite ends of the tubular metal blank with tube-end engaging structures so as to substantially seal opposite ends of the tubular metal blank;

closing the die assembly; and injecting fluid under pressure into the tubular metal blank placed in the die cavity to expand the tubular metal blank into conformity with the surfaces defining the die cavity.

2. The method of claim 1, further comprising:

effecting relative movement between said first die structure and said second die structure to close said die cavity without distorting the oval cross-sectional configuration of said tubular metal blank disposed therein.

3. The method of claim 2, said method further comprising:

progressively reducing the cross-sectional area of said die cavity after said die cavity is closed to thereby deform the oval cross section of said tubular metal blank within said die cavity after said die cavity is closed.

4. The method of claim 2, wherein said first die structure comprises a movable upper die structure, said method further comprising:

moving said movable upper die structure so as to close said die cavity.

5. The method of claim 4, wherein said second die structure comprises a fixed die structure, and wherein said method further comprises moving said upper movable die structure relative to said fixed die structure after said die cavity is closed so as to progressively reduce the cross-sectional area of said die cavity after said die cavity is closed and thereby deform the oval cross section of said tubular metal blank within said die cavity after said die cavity is closed.

6. The method of claim 5, wherein said second die structure further comprises a movable lower die structure, and wherein said method further comprises engaging said movable upper structure with said movable lower die structure to close said die cavity, and moving said movable lower die structure and said movable upper die structure relative to said fixed die structure so as to progressively reduce the cross-sectional area of said die cavity after said die cavity is closed and thereby deform the oval cross section of said tubular metal blank within said die cavity after said die cavity is closed.

7. The method of claim 1, wherein said greater first cross-sectional dimension of said die cavity extends in a generally vertical direction, and wherein said second cross-sectional dimension of said die cavity extends in a generally horizontal direction, and wherein said second cross-sectional dimension of said die cavity is greater than an outer diameter of said tubular metal blank taken along said minor axis, and wherein said placing step further comprises orienting said tubular metal blank within said die cavity such that said major axis of the cross-section thereof extends generally vertically, and such that said minor axis of the cross-section thereof extends generally horizontally.

8. The method of claim 1, wherein the surfaces defining said die cavity cooperate to provide said die cavity with a substantially rectangular cross-sectional configuration, and wherein said injecting causes said tubular metal blank to expand outwardly into conformity with said surfaces so as to provide the formed elongated tubular metal member with a substantially rectangular cross-section.

9. The method of claim 1, further comprising:

clamping spaced-apart portions of the tubular metal blank with clamping structures positioned on opposite ends of said die cavity, the clamping structures presenting clamping surfaces defining substantially oval surface configurations conforming to an oval outer peripheral surface of the tubular metal blank.

10. The method of claim 1, further comprising:

longitudinally compressing said tubular metal blank so as to replenish a wall thickness of said tubular metal blank as it is expanded.

11. The method of claim 1, wherein said closed box cross-sectional configuration includes four corners.

12. The method of claim 11, wherein said closed box cross-sectional configuration of said die cavity is a quadrilateral, thus having no more than said four corners.

13. An apparatus for forming a tubular metal blank into an elongated tubular metal member having a substantially box-shaped transverse cross-section, said box-shaped transverse cross-section including four corners, said apparatus comprising:

a die assembly having an internal die surface defining a die cavity, said die cavity having a substantially box-shaped surface configuration which includes four corners and being constructed and arranged to receive the tubular metal blank having a generally oval cross-section;

clamping structures positioned on opposite ends of said die cavity and constructed and arranged to securely clamp spaced-apart portions of the tubular metal blank, said clamping structures presenting clamping surfaces defining a generally oval surface configuration generally conforming to a generally oval outer peripheral surface of the tubular metal blank; and tube-end engaging structure constructed and arranged to engage and substantially seal opposite ends of the tubular metal blank, said tube-end engaging structure presenting a generally oval outer surface configuration conforming to a generally oval inner peripheral surface of the tubular metal blank.

14. The apparatus of claim 13, wherein said die assembly comprises:

a moveable upper die structure;

a second die structure which includes a fixed die structure;

said moveable upper die structure, and said second die structure being cooperable to define said die cavity;

wherein relative movement between said moveable upper die structure and said second die structure closes said die cavity, and wherein, after said die cavity is closed, movement of said moveable upper die structure with respect to said fixed die structure progressively reduces the cross-sectional area of said die cavity to deform the tubular metal blank within said die cavity.

15. The apparatus of claim 14, wherein said second die structure further comprises a moveable lower die structure, wherein said fixed die structure is received within an opening in said moveable lower die structure, and wherein said moveable upper die structure moves into engagement with said moveable lower die structure to close said die cavity.

16. The apparatus of claim 15, wherein said moveable lower die structure is mounted on a plurality of compressible spring members, wherein said moveable upper die structure is moved downwardly into engagement with said moveable lower die structure to close said die cavity, and wherein continued downward movement of said moveable upper die structure after said engagement moves said moveable lower die structure downwardly therewith against a bias of said spring members, and wherein said moveable upper and lower die structures are constructed and arranged so that said continued downward movement of said moveable upper die structure and downward movement of said moveable lower die structure reduces the cross-sectional area of said die cavity to deform the tubular metal blank.

17. The apparatus of claim 13, wherein said clamping surfaces defining said generally oval surface configuration each transition into a box U-shaped surface configuration as said clamping surfaces extend inwardly toward said die cavity.

18. The apparatus of claim 13, wherein said die cavity has a generally rectangular surface configuration.

19. The apparatus of claim 13, wherein said box-shaped transverse cross-section of said die cavity is a quadrilateral, thus having no more than said four corners.

20. A method of forming an elongated tubular metal member, said elongated tubular member being formed in a die cavity having surfaces constructed and arranged to provide said die cavity with a shape generally corresponding to a shape of said of said elongated tubular member, said die cavity having a closed box cross-sectional configuration, said cross-section of said elongated tubular member and hence of said die cavity having a relatively larger dimension thereof transverse to a relatively smaller dimension thereof, said method comprising:

placing a tubular metal blank having been roll formed to have a generally oval cross-section into said die cavity, and orienting said tubular metal blank such that a relatively larger cross-sectional dimension of said generally oval cross-section extends generally in a direction of said relatively larger cross-sectional dimension of said die cavity and such that a relatively smaller cross-sectional dimension of said generally oval cross-section extends generally in a direction of said relatively smaller cross-sectional dimension of said die cavity, said relatively smaller cross-sectional dimension of said generally oval cross-section being smaller than but generally approximating said relatively smaller cross-sectional dimension of said die cavity;

engaging and sealing opposite ends of the tubular metal blank;

closing the die assembly; and injecting fluid under pressure into the tubular metal blank so as to expand the tubular metal blank into conformity with the surfaces defining said die cavity and thereby transform said tubular metal blank into said elongated tubular metal member.

21. The method of claim 20 further comprising roll forming sheet metal to provide said the tubular metal blank with said oval cross-section.

22. The method of claim 21, further comprising reducing a cross-sectional area of said die cavity after said tubular metal blank is placed therein and after said die cavity is closed so as to crush said oval cross section of said tubular metal blank with said surfaces defining said die cavity.

23. The method of claim 20, wherein the die cavity has a substantially box shaped surface configuration and the elongated tubular metal member is formed to have a substantially box shaped cross-section.

24. The method of claim 20, further comprising:

longitudinally compressing said tubular metal blank so as to replenish a wall thickness of said tubular metal blank as it is expanded.

25. The method of claim 20, wherein said closed box cross-sectional configuration includes four corners.

26. The method of claim 25, wherein said cross-sectional configuration of said die cavity is a quadrilateral, thus having no more than said four corners.

27. A method of forming an elongated tubular metal member having a cross-sectional configuration such that it includes a first cross-sectional dimension which is greater than a second cross-sectional dimension orthagonal to said first cross-sectional dimension, said method utilizing a die assembly having first and second die structures having surfaces cooperable to define a die cavity having a first cross-sectional dimension which is greater than a second cross-sectional dimension generally orthagonal to said first cross-sectional dimension, said method comprising:

roll-forming sheet metal to form a tubular metal blank having an oval cross-section, said oval cross-section including a major axis along a greater diameter thereof and a minor axis along a smaller diameter thereof, said major and minor axes being generally orthagonal to one another;

placing the tubular metal blank into said second die structure, said second die structure being constructed and arranged to receive the tubular metal blank having said oval cross-section without distorting said tubular metal blank from its oval cross-section, said tubular metal blank being placed into said second die structure such that said major axis of said oval cross-section thereof extends in generally the same direction as said first cross-sectional dimension when said first and second die structures cooperate to form said die cavity and such that said minor axis of said oval cross-section thereof extends in generally the same direction as said second cross-sectional dimension of said die cavity when said first and second die structures cooperate to form said die cavity;

engaging opposite ends of the tubular metal blank with tube-end engaging structures so as to substantially seal opposite ends of the tubular metal blank;

injecting fluid under pressure into the tubular metal blank placed in the die cavity to expand the tubular metal blank into conformity with the surfaces defining the die cavity;

effecting relative movement between said first die structure and said second die structure to close said die cavity without distorting the oval cross-sectional configuration of said tubular metal blank disposed therein; and progressively reducing the cross-sectional area of said die cavity after said die cavity is closed to thereby deform the oval cross section of said tubular metal blank within said die cavity after said die cavity is closed.

28. An apparatus for forming a tubular metal blank into an elongated tubular metal member having a substantially box-shaped transverse cross-section, said apparatus comprising:

a die assembly having an internal die surface defining a die cavity, said die cavity having a substantially box-shaped surface configuration and being constructed and arranged to receive the tubular metal blank having a generally oval cross-section;

clamping structures positioned on opposite ends of said die cavity and constructed and arranged to securely clamp spaced-apart portions of the tubular metal blank, said clamping structures presenting clamping surfaces defining a generally oval surface configuration generally conforming to a generally oval outer peripheral surface of the tubular metal blank; and tube-end engaging structure constructed and arranged to engage and substantially seal opposite ends of the tubular metal blank, said tube-end engaging structure presenting a generally oval outer surface configuration conforming to a generally oval inner peripheral surface of the tubular metal blank; wherein said die assembly further comprising:

a moveable upper die structure;

a second die structure which includes a fixed die structure;

said moveable upper die structure, and said second die structure being cooperable to define said die cavity;

wherein relative movement between said moveable upper die structure and said second die structure closes said die cavity, and wherein, after said die cavity is closed, movement of said moveable upper die structure with respect to said fixed die structure progressively reduces the cross-sectional area of said die cavity to deform the tubular metal blank within said die cavity.

29. An apparatus for forming a tubular metal blank into an elongated tubular metal member having a substantially box-shaped transverse cross-section, said apparatus comprising:

a die assembly having an internal die surface defining a die cavity, said die cavity having a substantially box-shaped surface configuration and being constructed and arranged to receive the tubular metal blank having a generally oval cross-section;

clamping structures positioned on opposite ends of said die cavity and constructed and arranged to securely clamp spaced-apart portions of the tubular metal blank, said clamping structures presenting clamping surfaces defining a generally oval surface configuration generally conforming to a generally oval outer peripheral surface of the tubular metal blank; and tube-end engaging structure constructed and arranged to engage and substantially seal opposite ends of the tubular metal blank, said tube-end engaging structure presenting a generally oval outer surface configuration conforming to a generally oval inner peripheral surface of the tubular metal blank, said clamping surfaces defining said generally oval surface configuration each transitioning into a box U-shaped surface configuration as said clamping surfaces extend inwardly toward said die cavity.

* * * * *